US005900696A

United States Patent [19]

Buschmann et al.

[11] Patent Number: 5,900,696

[45] Date of Patent: May 4, 1999

[54] INCANDESCENT LAMP WITH SHOCK RESISTING SUPPORTS IN THE HOLLOW LEGS OF THE ENVELOPE

[75] Inventors: Jeffrey P. Buschmann, Lexington; David L. Shelton, Winchester, both of Ky.

[73] Assignee: Osramisylvania Inc., Danvers, Mass.

[21] Appl. No.: 08/147,179

[22] Filed: Nov. 3, 1993

[51] Int. Cl.[6] ..... H01K 1/28

[52] U.S. Cl. ..... 313/578

[58] Field of Search ..... 313/578, 579, 313/318, 580, 623, 624, 625, 628, 631, 269, 285, 292, 266; 439/619, 824, 278, 281

[56] References Cited

U.S. PATENT DOCUMENTS

| | | | |
|---|---|---|---|
| 996,268 | 6/1911 | MacDonald | 313/269 |
| 2,431,767 | 12/1947 | Murdock et al. | 313/266 |
| 2,450,130 | 9/1948 | Gordon et al. | 313/266 |
| 2,452,061 | 10/1948 | Krim | 313/266 |
| 2,472,865 | 6/1949 | Stutsman | 313/318 |
| 2,544,513 | 3/1951 | Stutsman | 313/266 |
| 3,733,508 | 5/1973 | Rainone et al. | 313/579 |
| 4,758,760 | 7/1988 | Cox et al. | 313/579 |
| 5,336,968 | 8/1994 | Strok et al. | 313/571 |

*Primary Examiner*—Sandra O'Shea
*Attorney, Agent, or Firm*—William E. Meyer

[57] ABSTRACT

An incandescent lamp with shock resisting supports having filament, first support rod, envelope, spacer, spacer, cap seal, and block is disclosed. The incandescent lamp with shock resisting supports yielding an incandescent lamp with a heavy filament structure supported by two support rods protected by a shock conditioning spacer and spring.

13 Claims, 3 Drawing Sheets

INCANDESCENT LAMP WITH SHOCK RESISTING SUPPORTS IN THE HOLLOW LEGS OF THE ENVELOPE

TECHNICAL FIELD

The invention relates to electric lamps and particularly to large wattage incandescent lamps. More particularly the invention is concerned with a support structure to position a filament securely and deter damage to the lamp seal.

BACKGROUND ART

Large wattage filament lamps use heavy filaments to produce large amounts of light. A large amount of heat is also produced, so it is necessary to enclose the filament in a large volume envelope. The filament is then mechanically supported, and electrically connected in the large volume by long metal rods. The heavy filament structure on the end of the long support rods produces a relatively large moment that can bend or twist the supports, or misalign the filament. This twisting and bending can also break down the seal structure of the lamp, where the metal rods, acting as electrical conduits pass through the envelope to the exterior. It is therefore common practice to include spring arms or similar braces that extend from the filament supports to the inside wall of the envelope. These braces limit the amount of sway the filament can go through, and therefore limit the amount of twisting or bending that can be applied to the seal structure. There is then a general need for an incandescent lamp with shock resisting supports.

High wattage studio lamps require substantial support of the filament throughout the lamp's life. Unlike stadium lights, or other large wattage fixed position lamps, studio lamps are treated roughly. They are frequently moved from one set to another, and similarly repositioned on a set. Unfortunately, the standard metal supports cannot maintain the needed support since in time the temperature eliminates the spring tension. The high operation temperature anneals the metal springs over their life, and they loose their ability to cushion the filament structure. This is particularly true of smaller, more highly tensed springs. Spring systems then tend to be effective only during the early life of the lamp. Large spring structures are additionally more costly due to the design and assembly complexity, and the larger material cost. The interaction between the metal supports and the envelope can also abrade the envelope, and making a possible failure point on the glass envelope. There is then a need for an improved support structure for studio lamps.

To extend the life of a filament lamp, or alternatively to increase its luminous output, halogens are commonly included in the envelope. The halogen chemical cycle is well known in lamp making. To not interfere with the halogen cycle, the braces and other support materials are therefore made of molybdenum or tungsten, both of with are expensive materials. As lamps get larger, the molybdenum or tungsten bracing structures become increasingly expensive. There is then a need for an incandescent lamp with shock resisting supports that do not interfere with the enclosed chemistry, and there is a need for such supports that use a minimal amount of expensive materials.

Examples of the prior art are shown in the following U.S. patents.

U.S. Pat. No. 3,543,962 issued to Carl L. Peterson on Dec. 1, 1970 for a High Wattage Quartz Halogen Lamp shows a studio lamp with the filament structure braced against envelope wall by the end arms of coiled springs.

U.S. Pat. 3,717,784 issued to W. G. Matheson on Feb. 20, 1973 for a Tungsten Halogen Lamp With Tungsten Mesh Deflector shows a studio lamp with glass legs sealed by molybdenum cups.

U.S. Pat. No. 4,023,060 issued to Bernard Pike on May 10, 1077 for a Ruggedized High Power Tungsten Halogen Lamp shows a studio lamp with glass legs sealed by molybdenum cups. The upper support rods ends are captured in cavities, and the side sections are braced against the glass envelope by spring arm ends.

U.S. Pat. No. 4,720,653 issued to Jeffrey P. Buschmann on Jan. 19, 1988 for an Electric Lamp Support Member Providing Both Compressive and Axial Support shows a studio lamp with glass legs sealed by molybdenum cups. The upper support rods ends are braced against the glass envelope by looping spring arms.

U.S. Pat. No. 4,758,760 issued to David A. Cox and Jeffrey P. Buschmann on Jul. 19, 1988 for a Convectively Cooled Ceramic Lamp Base shows a studio lamp with glass legs sealed by molybdenum cups. The upper rod ends are braced against the glass envelope by spring arms, and the glass legs are captured in a ceramic base.

U.S. Pat. No. 4,985,656 issued to Arnold Westlund Jr. and Jeffrey P. Buschmann on Jan. 15, 1991 for a Lamp with Re-Enforced Tubular Base Pins shows a studio lamp with glass legs sealed by molybdenum cups. The upper rod ends are braced against the glass envelope by spring arms, and the glass legs are captured in a ceramic base.

DISCLOSURE OF THE INVENTION

An incandescent lamp with shock resisting supports may be made with, an electric light source, a first support rod mechanically supporting at least a portion of the light source in an envelope enclosing the light source. The envelope is formed to include at least one hollow leg with an inside wall encircling a portion of the first support rod. A spacer is positioned in the hollow leg intermediate the support rod and the hollow leg to limit motion of the support rod with respect to the hollow leg. A seal is made to seal between the support rod and the leg, and electrical connections are sealed through the envelope to connect to the light source and thereby to provide electric power for the light source.

BEST MODE FOR CARRYING OUT THE INVENTION

Figure 1:
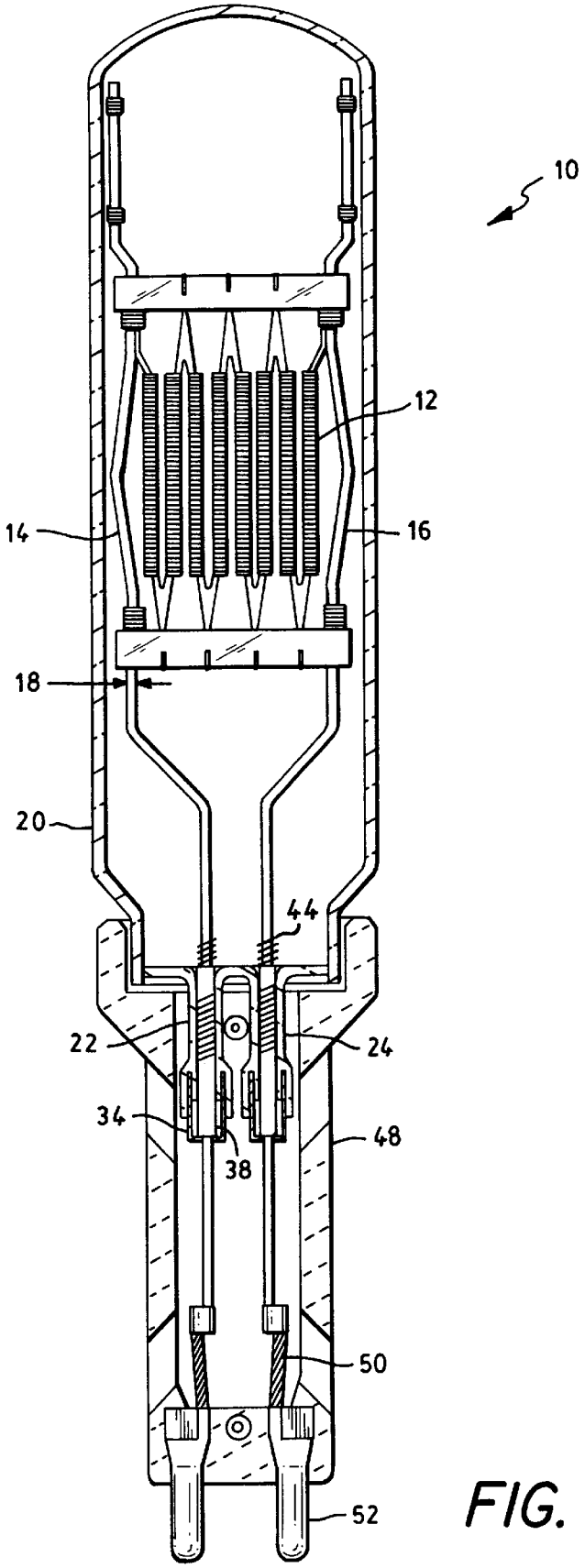
FIG. 1 shows a cross sectional view of a preferred embodiment of an incandescent lamp with shock resisting supports.

FIG. 1 shows a preferred embodiment of an incandescent lamp 10 with shock resisting supports. Like reference numbers designate like or corresponding parts throughout the drawings and specification. The incandescent lamp 10 with shock resisting supports may be assembled from a filament 12, at least a first support rod 14, an envelope 20 with at least a first hollow leg 22, and a spacer 38.

The filament 12 may be made out of tungsten wire to have the general form of a coiled coil arrayed as a series of parallel rows. The filament 12 may include a series of support hooks anchored in quartz cross bars to help position the filament 12. It is common practice to embed the support hooks in quartz or glass bars extending perpendicular to the parallel rows of the tungsten filament 12. The ends of the filament 12 and the quartz cross bars are usually respectively coupled to a first support rod 14, and a second support rod 16.

The first support rod 14 may be made out of tungsten to have the general form of a straight rod conveniently angled at various points forming connected straight coplanar sections. The filament 12, at a first end is then supported and electrically connected through the first support rod 14. The support rod 14 has an outside diameter 18 sufficient to provide support, and electrical connection for the filament 12. A similar second support rod 16 may be used to support and electrically connect a second end of the filament 12.

Figure 2:
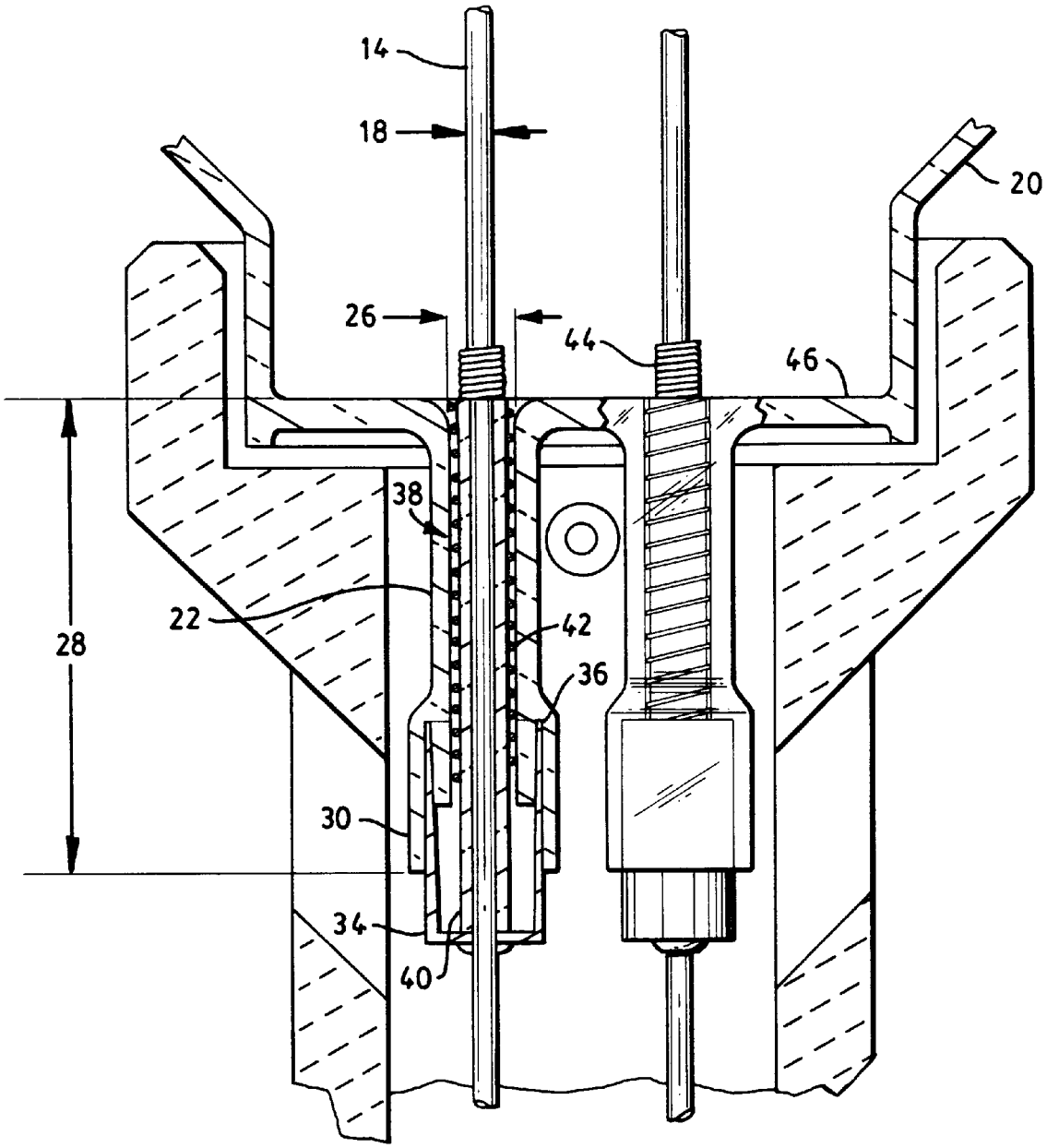
FIG. 2 shows a detailed view, partially broken away of the leg region of FIG. 1.

The envelope 20 may be made out of glass or quartz to have the general form of a right cylindrical tube. The top end may be sealed with a dome or a flat plate. The bottom may be similarly sealed, and is formed to include at least one or more hollow legs 22 (FIG. 2), 24. The first leg 22 has an internal diameter 26, a length 28 and a sealed end 30. The preferred support rod's 14 outside diameter 18 is from two to ten times smaller than the first leg's 22 inside diameter 26. The support rod's 14 outside diameter 18 is sufficiently smaller than the first leg's inside diameter 26 to form a gap between the first leg 22 and the first support rod 14. At the distal end of the first leg 22 is a seal structure. While a press seal or other seal may be used, the preferred seal is a pressed in cap seal 34.

The first support rod 14 seals to the seal structure and then extends to the exterior of the envelope 20. The preferred seal structure comprises a circular metal cup 34 with a rim 36 and a bottom with a centrally formed hole. The first support rod 14 and the centrally formed hole are sized to allow the rod 14 to pass through the hole leaving a gap that is bridgeable by brazing. The first support rod 14 positioned in the formed hole is then brazed to the cup 34 to seal between the first support rod 14, and the cup 34. The rim 36 has a diameter sufficient to circumferentially aligned with the distal end of the first leg 22. The distal end of the first leg 22 may then be melt fused to the rim 36.

Positioned in the gap between the first support rod 14, and the inside wall of the first leg 22 is a spacer 38 (FIG. 1). The spacer 38 should be made of a material compatible with the filament 12 and enclosed heat and chemistry of the lamp. The spacer 38 should be sufficiently mechanically sturdy to resist the forces between the first support rod 14 and the first leg 22. Since the formed gap between the support rod 14 and the first leg 22 is essentially tubular, it is convenient to use a tubular shaped spacer 38. Other shapes may be used, such as a tube materially reduced with transaxial holes, or a tubular corrugation. The first support rod 14 can then extend through an axial passage in the spacer 38. Similarly, the hollow length of the first leg 22 may be substantially filled by spacer 38 in both the radial and axial directions.

Figure 3:
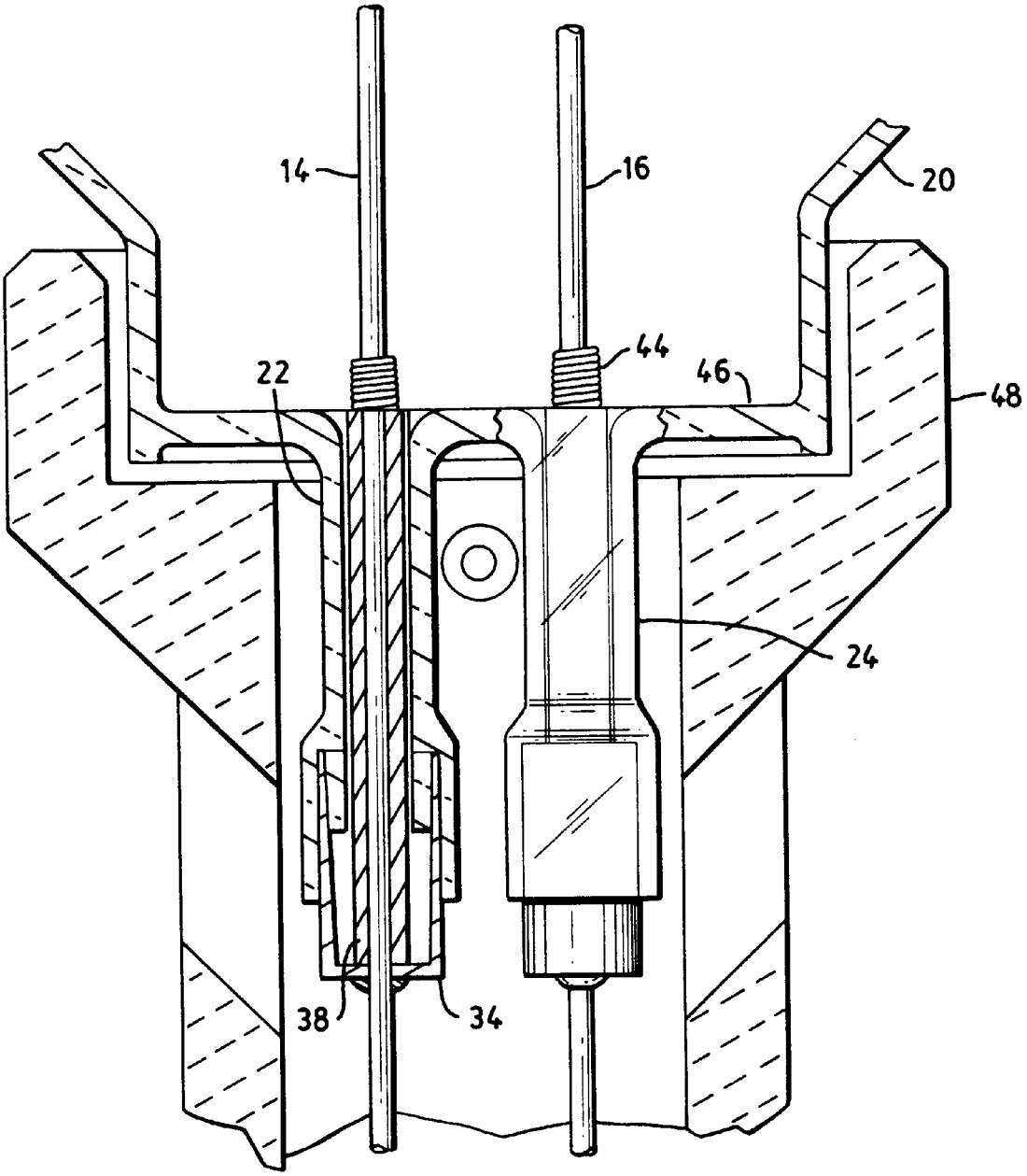
FIG. 3 shows a view of an alternatively embodiment, partially broken away of the leg region of FIG. 1.

Since the filament 12 is made of tungsten, the support spacer 38 may also be made of tungsten, but the high cost of tungsten would make a tungsten spacer 38 impractical. FIG. 3 shows a view of a solid metal spacer, a less preferred embodiment. The view is an adaptation, partially broken away of the leg region of FIG. 1.

Quartz, or the envelope material on the other hand is substantially less expensive and may also be used as a spacer material. The quartz or envelope material is resistant to the enclosed lamp chemistry, and also provide a stiff material at the temperature of lamp operation. A spacer 38 made of the same or similar material as that of the envelope 20 if positioned directly adjacent the inside wall of the leg 22, is likely to locally weld or fuse to the leg 22 when the envelope 12 is joined to the base plate 46. The local welding creates irregularly positioned bonds. The thermal expansions and contractions of the lamp during heat up and cool down can stress these irregular bonds, causing them to fracture. Similarly, filament 12 sway may also cause these irregular bonds to fracture. As they fracture, cracks may extend from the irregular bond areas into the envelope 20, causing the envelope to weaken or fail. A quartz spacer is therefore not believed to be practical if positioned directly adjacent the leg.

The preferred spacer 38 is therefore formed from a sleeve 40 (FIG. 2) and a separator 42. A tubular sleeve 40 may be formed from relatively inexpensive glass, quartz or other envelope material. The sleeve 40 has an inside diameter slightly larger than the outside diameter of the rod 14, and a length that is approximately equal to the length of the first leg 22. The sleeve 40 is then positioned around the rod 14, and inside the first leg 22. The separator 42 is positioned to interface between the inside wall of the first leg 22, and the outside wall of the sleeve 40. The separator 42 is made of a material that does not readily bond well with the first leg 22 over the range of expected lamp temperatures of construction or operation, and additionally has little affect on the lamp chemistry. The preferred spacer 38 then comprises a quartz, glass or other envelope like material in the form of a tubular sleeve 40, and a metal separator 42 made of a metal that is compatible with the lamp chemistry. In particular, a tungsten coil may be positioned around a quartz sleeve 40 to separate the sleeve 40 from the inside wall of the first leg 22. The tungsten separator 42 does not fuse with the first leg 22, or the sleeve 40. While the separator 42 could float freely around the sleeve 40, the resulting rattle could be disturbing to customers used to shaking a lamp to test for defects. The separator 42 could have a slightly larger diameter than the interior diameter of the first leg 22 and thereby be placed in a compressed tight fit against the first leg's 22 inside wall. The preferred separator 42 has a slightly smaller diameter than the outside diameter of the sleeve 40, so as to be in tensed in a tight fit against the outer wall of the sleeve 40.

To keep the sleeve 40 from traveling along the length of the rod 14, a block 44 is positioned along the rod 14 to resist movement of the sleeve 40. A swage mark, ripple bend, or welded piece could be placed along the rod 14 to interfere with the sleeve 40 from sliding along the rod 14 and thereby act as a block. The preferred block 44 is a tightly coiled tungsten spring having a coil diameter sufficient to clamp the coil firmly to the rod 14, and having a wire diameter sufficient to close and at least slightly exceed any gap between the rod 14 and the sleeve's 40 inside diameter. The first support rod 14 supports and frictionally resists movement of the block 44. The coil 42 can then be slide onto the rod 14, and properly positioned to block the sleeve 40 in place. The sleeve 40 has a portion, such as an inside wall formed to butt against the block 44. The sleeve 40 is then held along the support rod 14 by the block 44. The first support rod 14 is trapped in the sleeve 40. The sleeve 40 positioned against the separator 42, which nearly fill the hollow leg 22.

The first support rod 14 extends from the filament 12 through a block 44, and a sleeve 40 carrying a separator 42 that are positioned in the first leg 22. The rod 14 then passes through a seal end, and out to the exterior of the lamp 10. In combination the sleeve 40 and separator 42 form a spacer that substantially fills the gap between the rod 14, and the first leg 22, whereby movement of the rod 14 near the seal is substantially restricted. The moment arm of rod 14 is thereby shortened, stiffening the support for the filament, and preventing filament sway. The forces on the rod 14 are then resisted in the leg 22 and spread along the length of the sleeve 40 and separator 42 to the length of the leg 22. Any remaining rod 14 movement is insufficient to injure the seal.

A working example of a 20 kilowatt, 220 volt studio lamp was made some of whose dimensions were approximately as follows: The filament was made of coiled tungsten folded to have eight parallel, and adjacent sections. The first and second support rods were similarly made of tungsten, and had a diameter of 3.175 millimeters (0.125 inch) and an over all length of 450.1 millimeters (17.72 inch). The envelope was made of a quartz tube with a diameter of 100.0 millimeters (3.93 inch) and a length of 360.0 millimeters (14.17 inch). The top was domed and the bottom had a necked region that was sealed with a plate 70.1 millimeters (2.76 inch) in diameter including two hollow leg sections. Each leg was 58.72 millimeters (2.312 inch) long, 8.00 millimeters (0.315 inch) inside diameter, and 12.2 millimeters, (0.48 inch) outside diameter. A molybdenum cup with a diameter of 12.6 millimeters (0.496 inch) and 24.7 millimeters (0.97 inch) was fused along its rim to the distal end of the each hollow leg. Each cup was formed with a central hole to receive a support rod. The support rods passed through the center of each cup where a brazed seal was made. The sleeve was made of quartz which is compatible with the filament and the enclosed lamp chemistry. The sleeve had the from of a tubular section with an inside diameter of 3.71 millimeters (0.146 inch), an outside diameter of 7.01 millimeters (0.276 inch), and an overall length of 56.0 millimeters (2.20 inch). The support rod was passed through the sleeve leaving a total gap of about 0.535 millimeters (0.02 inch). A sleeve was positioned in each hollow leg leaving a total gap of 0.99 millimeters between the sleeve and the hollow leg. The sleeve to leg gap was partially filled by a separator formed from a tungsten wire coil having a wire diameter of 0.25 millimeter (0.01 inch). The separator had a coil diameter of 6.98 millimeters (0.275 inch), with a pitch of 10 turns per inch over a length of 45.0 millimeters (1.77 inch). With the separator positioned in the gap between the sleeve and the inner wall of the legs the total gap was reduced to about 0.49 millimeters (0.019 inch). The block was made of molybdenum wire with a wire diameter of 0.74 millimeters (0.0291 inch), a coil diameter of 4.3 millimeters (0.169 inch). The coil had about 4 turns giving a block coil height of about 3.0 millimeters (0.118 inch).

The lamp may be assembled by first forming the filament structure and attaching it to the support rods. A blocking spring is then slipped over the exposed end of the support rod to act as a block for the sleeve, carrying a separator coil. A base plate 46 with two hollow legs is then formed and slipped over the support rods, the sleeves and the separators. Seal caps, each with a center hole are then slipped over the exposed ends of the support rods. The seal caps are then advanced to abut the sleeves. As each seal cap is advanced further the sleeve is forced to abut the block. The sleeve, separator coil and block are then slid along the length of the support rod until the seal cap is properly positioned along the length of the support rod. The block has resisted the free advance of the sleeve and separator, so the sleeve and separator are now positioned tightly in line along the rod, and inside in the length of the hollow leg, pinned between the block and the cup. The support rod is then braised to the cup, thereby sealing the support rod and seal cap. The end of the hollow leg is then melted by flame, and the rim or forward edge of the seal cup is driven into the melted leg end to seal the cup and leg. The envelope body is then formed and the filament structure inserted through the open end of the envelope body. The base plate 46 with the attached legs and filament structure is then mated with the edge of end hole of the envelope body. The edges of the open envelope hole and the base plate 46 are then flame melted and fused together using rollers to neck the envelope down to the diameter of the base plate 46. Fusing the larger pieces together requires great heat, and it is here that the separator's function is useful. The envelope is then evacuated through a tubulation and properly filled and finally seal as is known in the art. The completed envelope is then positioned, and if necessary cemented in a base, such as a ceramic base 48, and the support rods are coupled to electrical connectors, such copper wires 50 coupled to pins 52 held in the ceramic base 48.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An incandescent lamp with shock resisting supports comprising:

a) an electric light source, b) a first, electrically conductive support rod serving as an electrical connection to the light source, and as a mechanical support for at least a portion of the light source, c) an envelope enclosing the light source, and including at least one hollow, projecting leg with an inside wall encircling a portion of the first support rod, d) a substantially rigid, detached spacer positioned in the hollow leg intermediate the support rod and the hollow leg to limit motion of the support rod with respect to the hollow leg, the spacer being approximately coextensive with the leg, and e) an electrically conductive seal to seal between the support rod and the leg, permitting electrical connection through the envelope to provide electric power to the light source.

2. The lamp in claim 1, wherein the spacer is a metal sleeve positioned in the hollow leg and around the support rod.

3. The lamp in claim 1, wherein the spacer comprises a sleeve positioned in the hollow leg and around the support rod, and a separator positioned intermediate the sleeve and the inside wall of the hollow leg.

4. The lamp in claim 3, wherein the envelope is composed of substantially of silica, the sleeve is composed of substantially of silica, and the separator is composed of a metal.

5. The lamp in claim 4, wherein the metal is tungsten.

6. The lamp in claim 3, wherein the separator is a metal wire encircling the sleeve at least one time.

7. The lamp in claim 6, where in the metal wire separator is a coil with a coil diameter sufficiently small to cause the separator to cling to the sleeve.

8. The lamp in claim 3, wherein the gap between the rod and the inside wall of the leg is substantially filled by the spacer.

9. The lamp in claim 3, wherein the gap between the rod and the inside wall of the leg is substantially filled by the sleeve and the separator.

10. The lamp in claim 1, wherein the spacer is at least partially positioned along the rod by a block restricting motion of the spacer in the direction towards the light source.

11. The lamp in claim 7, wherein the block comprises a wire frictionally engaged to the rod.

12. The lamp in claim 1, having a second similarly formed second leg, second support rod, second spacer and second seal between the second leg and second support rod are included and the support rod and second support rod comprise the electrical connections for the light source.

13. An incandescent lamp with shock resisting supports comprising:

a) a filamentary electric light source, b) a first, electrically conductive support rod serving as an electrical connection to the light source, and as a mechanical support for at least a portion of the light source, c) an envelope enclosing the light source, and including at least one hollow, projecting leg with an inside wall encircling a portion of the first support rod, d) a substantially rigid detached sleeve positioned in the hollow leg and around the support rod, the sleeve being approximately coextensive with the leg, and e) a separator positioned intermediate the sleeve and the inside wall of the hollow leg whereby the sleeve and separator limit the motion of the support rod with respect to the hollow leg, f) a block comprising a wire frictionally engaged to the rod adjacent an end of the sleeve to at least partially positioned the sleeve along the rod by restricting motion of the sleeve in the direction towards the filament light source, g) an electrically conductive seal to seal between the support rod and the leg, permitting electrical connection through the envelope to provide electric power to the light source.

* * * * *